US009677395B2

(12) United States Patent
Affre De Saint Rome et al.

(10) Patent No.: US 9,677,395 B2
(45) Date of Patent: Jun. 13, 2017

(54) DEVICE AND METHOD FOR FAST DEPLOYMENT OF DOWNHOLE TOOL

(71) Applicant: Sercel SA, Carquefou (FR)

(72) Inventors: Ronan Affre De Saint Rome, Carantec (FR); Jerome Decressat, Puteaux (FR)

(73) Assignee: SERCEL, SA, Carquefou (FR)

( * ) Notice: Subject to any disclaimer, the term of this patent is extended or adjusted under 35 U.S.C. 154(b) by 278 days.

(21) Appl. No.: 14/521,630

(22) Filed: Oct. 23, 2014

(65) Prior Publication Data

US 2015/0369034 A1 Dec. 24, 2015

Related U.S. Application Data

(60) Provisional application No. 62/013,882, filed on Jun. 18, 2014.

(51) Int. Cl.

| | |
|---|---|
| ***E21B 33/068*** | (2006.01) |
| ***E21B 33/072*** | (2006.01) |
| ***E21B 47/01*** | (2012.01) |
| ***E21B 15/00*** | (2006.01) |
| ***E21B 17/02*** | (2006.01) |
| ***E21B 19/084*** | (2006.01) |
| ***E21B 19/02*** | (2006.01) |

(52) U.S. Cl.

CPC ..... *E21B 47/01* (2013.01); *E21B 15/00* (2013.01); *E21B 17/028* (2013.01); *E21B 19/02* (2013.01); *E21B 19/084* (2013.01); *E21B 33/072* (2013.01)

(58) Field of Classification Search

CPC ..... E21B 33/068; E21B 33/072; E21B 19/02; E21B 19/06; E21B 19/08; E21B 19/084

See application file for complete search history.

(56) References Cited

U.S. PATENT DOCUMENTS

| | | | | |
|---|---|---|---|---|
| 3,494,484 | A * | 2/1970 | McFadden | E21B 19/06 294/110.1 |
| 4,681,168 | A | 7/1987 | Kisling, III | |
| 2006/0131015 | A1 * | 6/2006 | Kanayama | E21B 23/01 166/254.2 |
| 2007/0044970 | A1 | 3/2007 | Streater, Jr. et al. | |

(Continued)

FOREIGN PATENT DOCUMENTS

| | | |
|---|---|---|
| GB | 1271250 | 4/1972 |
| WO | 2009/065574 A2 | 5/2009 |

OTHER PUBLICATIONS

Partial European Search Report in corresponding European Application No. 15 17 2101 dated Apr. 19, 2016.

(Continued)

*Primary Examiner* — George Gray

(74) *Attorney, Agent, or Firm* — Patent Portfolio Builders PLLC

(57) ABSTRACT

Method and deployment device for a downhole tool. The device includes a body; a door rotatably attached to the body and configured to have an open position for allowing at least a portion of a fishing neck of the downhole tool to contact the body and a close position that secure the at least a portion of the fishing neck inside the deployment device; a bend restrictor attached to the body and configured to receive a logging cable of the downhole tool; and a locking mechanism for securing the door in the close position.

20 Claims, 12 Drawing Sheets

(56) References Cited

U.S. PATENT DOCUMENTS

| | | | | |
|---|---|---|---|---|
| 2008/0156477 | A1* | 7/2008 | Aivalis | E21B 23/00 166/53 |
| 2008/0173441 | A1* | 7/2008 | Bowles | E21B 33/072 166/70 |
| 2008/0302542 | A1 | 12/2008 | Pessin et al. | |
| 2011/0139438 | A1 | 6/2011 | Nold et al. | |
| 2015/0042487 | A1* | 2/2015 | Hrametz | E21B 47/12 340/854.4 |

OTHER PUBLICATIONS

Office Action mailed Mar. 10, 2017 in related EP Application No. 15 172 101.6.

* cited by examiner

DEVICE AND METHOD FOR FAST DEPLOYMENT OF DOWNHOLE TOOL

BACKGROUND

Technical Field

Embodiments of the subject matter disclosed herein generally relate to an apparatus and method for efficiently deploying a downhole tool.

Discussion of the Background

A downhole tool may be a device used to conduct seismic surveys in downhole environments, such as, for example, inside of wells used for oil and gas extraction. Downhole tools may contain sensors, such as, for example, geophones, temperature sensors, pressure sensors, accelerometers, optical sensors, etc. In order to function properly, a downhole tool that has been lowered into a well may need to be anchored in place with the tool pressed up against the wall of the well. Several tools may be connected together, top to bottom, along with other survey equipment, using a cable, and lowered into a well.

FIG. 1 depicts an exemplary downhole tool 101, which in this case is a seismic tool. Seismic tool 101 may include a main housing 102, upper cable head 103, lower cable head 104, and anchoring arm 106. A logging cable 105 may be connected to the upper cable head 103 at the top and the lower cable head 104 at the bottom of the seismic tool 101. Main housing 102 may be a housing of any suitable shape and made of any suitable material for enclosing any equipment, such as, for example, sensors, motors, and other mechanical, electric, and electronic components, within the seismic tool 101. Upper cable head 103 and lower cable head 104 may enclose seismic tool 101 on the top and bottom ends, respectively, and may be made of a similar material to the main housing 102 or any appropriate material. Anchoring arm 106 may be made of any suitable material in any suitable shape for allowing seismic tool 101 to be lowered into a well when anchoring arm 106 is in a closed position, and to anchor seismic tool 101 against the wall of the well when anchoring arm 106 is in an open position. For example, anchoring arm 106 may be made of metal in a curved scoop shape. Anchoring arm 106 may be attached to the main housing 102 in any suitable manner to allow anchoring arm 106 to switch between closed and open positions. FIG. 2 shows another downhole tool 201, which is similar to downhole tool 101, but does not have an anchoring arm. For example, if the downhole tool measures the pressure and/or temperature inside the well, the tool does not have to be in contact with the casing or tubing of the well.

Logging cable 105 may connect the seismic tool 101 to other devices, such as, for example, other seismic tools, telemetry devices, or electronic devices that allow the seismic tool 101 to transmit data to a computer. For example, seismic tool 101 may be deployed in a string of similar seismic tools, and may be connected to other seismic tools 101 above and below through the logging cable 105 as illustrated in FIG. 3. FIG. 3 shows a system 300 that includes multiple tools 306 to 310 deployed in a well 302. Tools 306 to 310 may be lowered into the well 302 from the surface by main logging cable 304. Logging cable 105 may connect tools 306 to 310 to each other, a telemetry unit 305 and an end unit 320. Main logging cable 304 may connect an electronic device 322, which is part of end unit 320, to telemetry unit 305, and may be used to control the descent and ascent of all of the seismic survey equipment within the well 302. In one application, main logging cable 304 may be different from logging cable 105. Electronic device 322 may serve as an interface between the tools 306 to 310 and a computer 324 through a link 326. Computer 324 may be any suitable computing device for gathering data from and sending commands to tools 306 to 310, and the end unit 322. Telemetry unit 305 may collect data from sensors in tools 306-310 for transmission to the electronic device 322 and computer 324.

When tools 306-310 are deployed inside the well 302, a large tension may develop within logging cable 105, as the number N of the tools may vary between 20 and 200 and the weight of each unit may be in the tens of kilograms. Thus, a total weight of the tools when deployed in the well and hanging from main logging cable 304 can reach several tons. Further complicating the deployment process is the necessity to use a crane for lifting each tool from the ground and deploying it in the well with all the other deployed modules hanging from the current module. This process is schematically illustrated in FIG. 4 in which plural tools 406-410 are shown, some of them (409, 410) already deployed in well 402, and some of them (406, 407) waiting to be deployed.

A crane 430 (partially shown) is connected with cables 432 to corresponding brackets 434 of a deployment device 436 (called "bottle" in the art). Deployment device 436 is a cylinder configured to house tool 408, that is connected through logging cable 105 to a next tool 407 and also to tools 409 and 410, already deployed in the well. Thus, a large force (exerted by all the tools 409 and 410 already deployed inside the well) is applied to current tool 408, which is waiting its turn for being deployed inside the well. Current tool 408 is connected with another logging cable 105 to a next tool 407, which lies on the ground with other tools 406. A second deployment device 438 is used for housing the next tool 407. Note that existing deployment devices are configured to receive the entire tool, except a top portion. Current tool 408, together with first deployment device 436, are supported by a rig-up plate 440, which sits on ground 442 on top of well 402. Rig-up plate 440 has a slit (not shown) that permits logging cable 105 to be removed when required. Both deployment devices 436 and 438 also have corresponding slits extending all the way along their length so that they can be removed from logging cables 105. After current tool 408 and first deployment device 436 are placed on rig-up plate 440, crane's cables 432 are removed from first deployment device 436 and are now attached to the second deployment device 438. After next tool 407 is secured to second deployment device 438, crane 430 raises second deployment device 438 together with next tool 407 until current tool 408 is raised from its first deployment device 436. As this stage, the first deployment device 436 is removed from logging cable 105 and the next tool 407 is lowered with its second deployment device 438 on top of the rig-up plate 440, which is placed on top of the well after current tool 408 has entered the well. Note that this operation is necessary as an opening in the rig-up plate is smaller in diameter than an external diameter of the tool. Next, the freed first deployment device 436 is used to house the next tool 406 and the process continues in this way until all the tools are deployed inside the well.

Prior to being deployed, the tools are connected to each other, both mechanically and electrically along a bidirectional link. Thus, one can communicate with the tools along the bidirectional link. Therefore, prior to deploying the tools into the well, they are connected to each other as illustrated in FIG. 4 and tested. However, it is customary to unchain the tools after this test and chain them again while being deployed in the well.

The operation of deploying the tools into the well is of particular complexity as discussed above with regard to FIG. 4. This operation brings up safety issues. Indeed, the mechanical tension induced by the weight of the tools already disposed into the well could reach several tons. As the tools are laid onto the floor prior to being deployed, there is a risk that the tools may get carried by the tension of the logging cable 105 and hurt the operator. Therefore, there is a need to control the tension in the logging cable and deploy tools into the well with no tension and no risk regarding human safety.

There are further drawbacks with the method described above. There is a need for two deployment devices to actually deploy one tool. Also, the deployment process is slow, which increase the cost of the operation. Further, as the deployment tools have to be constantly raised and lowered under high tension, it increases the safety risks associated with the equipment manipulation. In particular, when removing the deployment device, it happens sometimes that it falls down on the floor, potentially injuring the equipment's operator.

Thus, there is a need for an apparatus and method for deploying in a faster and safer way a chain of downhole tools.

SUMMARY

In one embodiment, there is a deployment device for a downhole tool, the device including a body, a door rotatably attached to the body and configured to have an open position for allowing at least a portion of a fishing neck of the downhole tool to contact the body and a close position that secure the at least a portion of the fishing neck inside the deployment device, a bend restrictor attached to the body and configured to receive a logging cable of the downhole tool, and a locking mechanism for securing the door in the close position.

In another embodiment, there is a deployment system for deploying a downhole tool in a well. The deployment system includes plural downhole tools for measuring at least one parameter within the well, a deployment device for deploying the plural downhole tools, a rig-up plate for covering a head of the well and supporting the plural downhole tools already deployed in the well, and a crane configured to connect to the deployment device. The deployment device is configured to latch onto at least a portion of a fishing neck of a downhole tool for raising or lowering it.

In still another embodiment, there is a method for deploying a chain of downhole tools inside a well. The method includes electrically and mechanically connecting the downhole tools to each other while on the ground; coupling a current downhole tool with a deployment device, wherein the deployment device is configured to latch on at least a portion of a fishing neck of the current downhole tool; raising with a crane the deployment device and the current downhole tool until a previous downhole tool also raises from a rig-up plate sitting on top of the well; removing a clamp from the previous downhole tool; lowering the current downhole tool until it enters through the rig-up tool; clamping the clamp onto the current downhole tool; and removing the deployment device from the current downhole tool.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 5 illustrates a deployment device in an open position while

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. In various embodiments as illustrated in the figures, an apparatus and method for quickly and safely deploying a downhole tool inside a well are discussed. However, the invention is not limited to deploying a downhole tool inside a well, but it may be applied to other situations, as for example, placing various modules inside a tube. Those skilled in the art would recognize other applications of the embodiments discussed herein.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a single deployment device is used to deploy a plurality of tools in a well. The single deployment device has a body and a door that can be opened to receive the tool and then closed to secure the tool inside the single deployment device. A predetermined portion of the tool (e.g., a portion of the tool called the "fishing neck") is secured inside the single deployment device while the remaining of the tool is free. In one application, the predetermined portion of the tool is not used for deployment by the existing deployment methods. A clamp may be used to fix in place the tool, at the head of the well, while the single deployment device is removed and attached to a next tool to be deployed. As discussed now, the single deployment device is more efficient and safe than the existing deployment tools.

Figure 5:
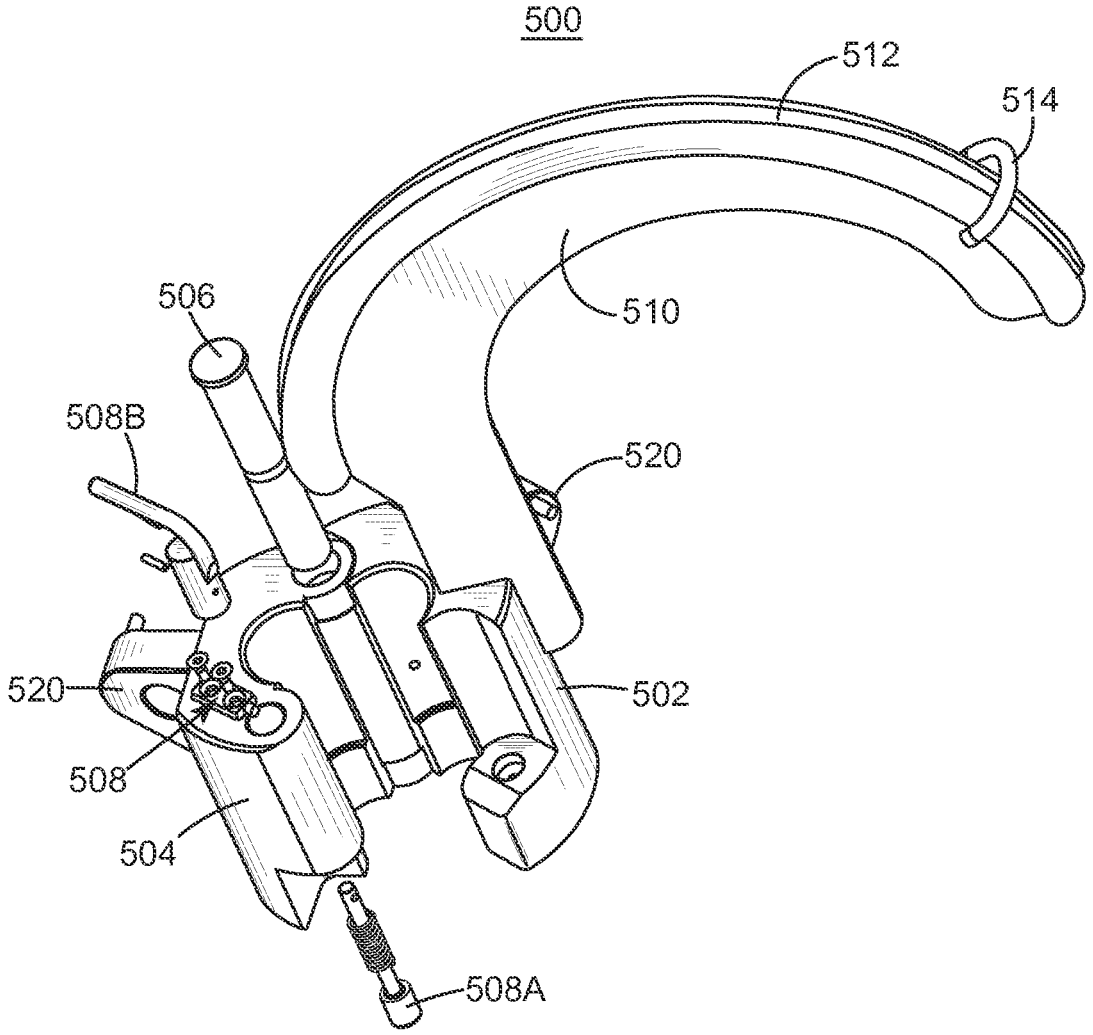
Figure 6:
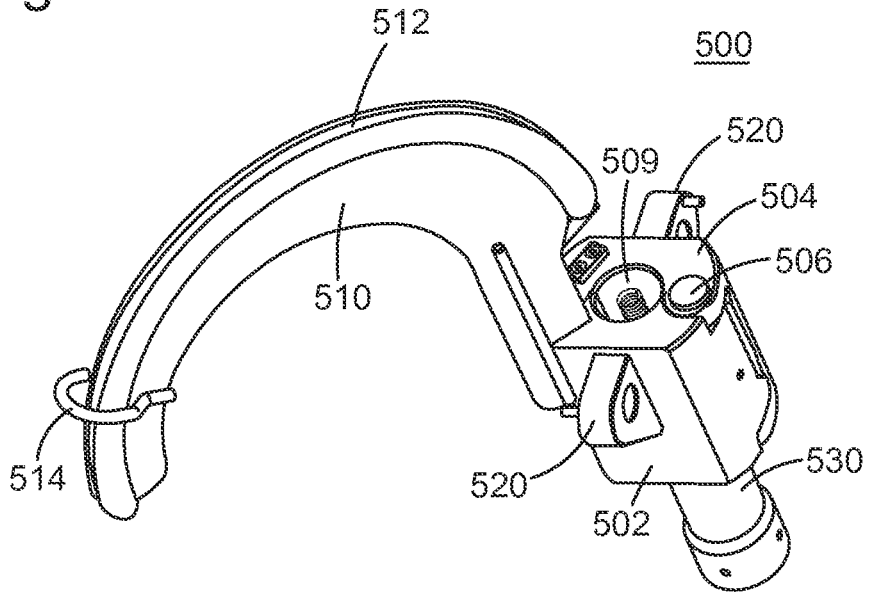
FIG. 6 illustrates the deployment device in a closed position.

In one embodiment illustrated in FIG. 5, a deployment device 500 is shown in an exploded view. Deployment device 500 has a body 502 to which a door 504 is attached, for example, with a bolt 506. When door 504 closes as illustrated in FIG. 6, it forms, together with body 502, a latching compartment 509 that is configured to latch on a predetermined portion of the tool, as discussed later. Those skilled in the art would recognize that deployment device 500 may have more parts, e.g., one or more bodies and one or more doors.

Deployment device 500 may include a bend restrictor 510 that has a groove 512 shaped to receive logging cable 105 that extends from the tool. Logging cable 105 may be flexible or not. Bend restrictor 510 is configured to protect logging cable 105 from excessively bending when the tool is raised by the crane so that the mechanical and electrical capabilities of the logging cable 105 are preserved. Bend restrictor 510 may also include one or more clamps 514 for securing logging cable 105 within groove 512 when the tool is raised and lowered for deployment.

Figure 7:
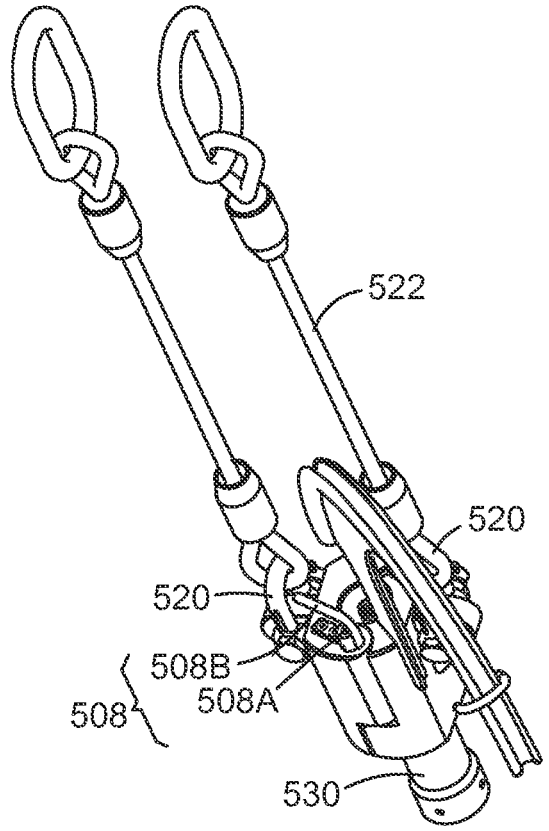
FIG. 7 illustrates a deployment device being connected to a crane.

One or more flanges 520 are provided on the deployment device 500, as illustrated in FIGS. 5 and 6. These flanges are used for tying cables 522 (see FIG. 7) belonging to the crane and for raising and lowering the deployment device and associated tool. In one embodiment, one flange 520 is located on body 502 and the other flange on door 504, so that there is symmetry of the flanges around the deployment device. FIGS. 6 and 7 show tool 530 locked into deployment device 500. Deployment device 500 may also include a locking mechanism 508 for locking door 504 to body 502 to prevent accidental opening of the door while the deployment device holds the tool. Locking mechanism 508 may include the actual lock unit 508A and a lever 508B that is actuated by the operator, as illustrated in FIGS. 5 and 7.

Figure 1:
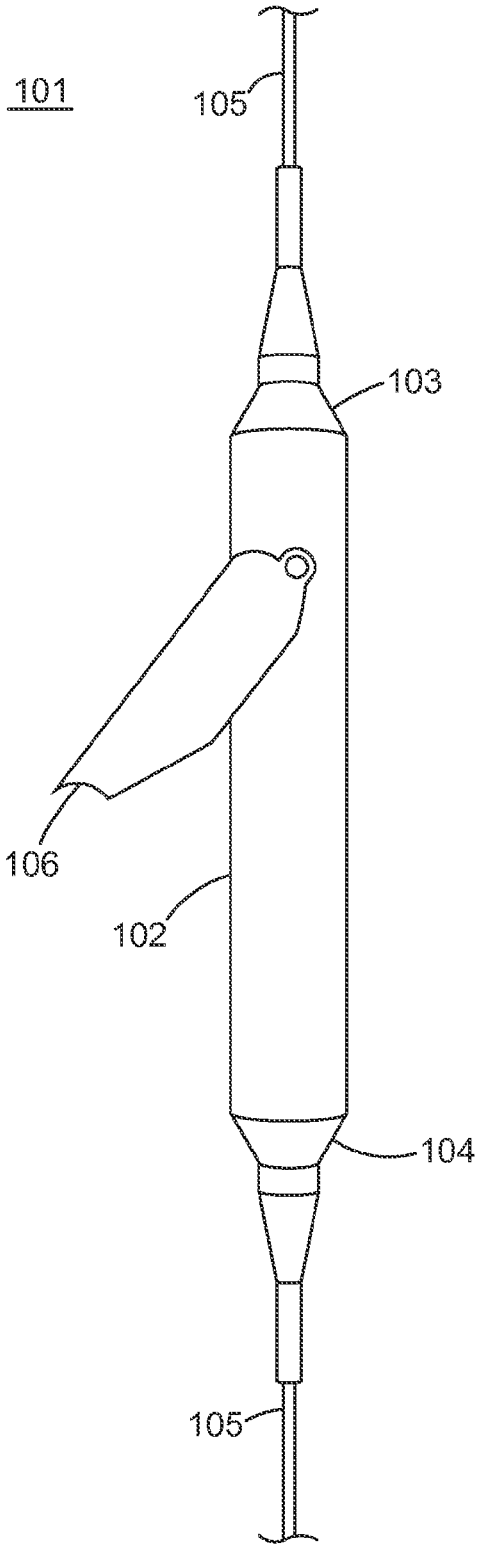
FIG. 1 depicts an exemplary downhole tool having an anchoring arm.
Figure 2:
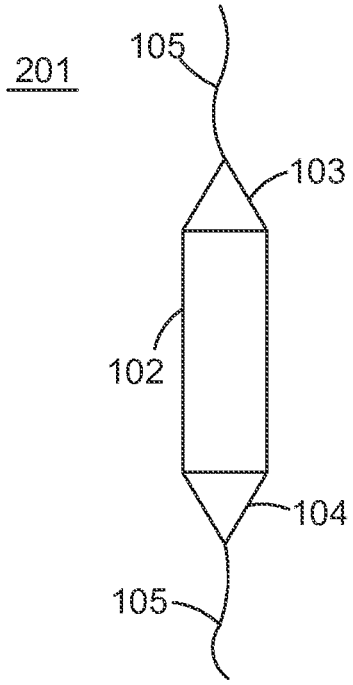
FIG. 2 depicts an exemplary downhole tool without an anchoring arm.
Figure 3:
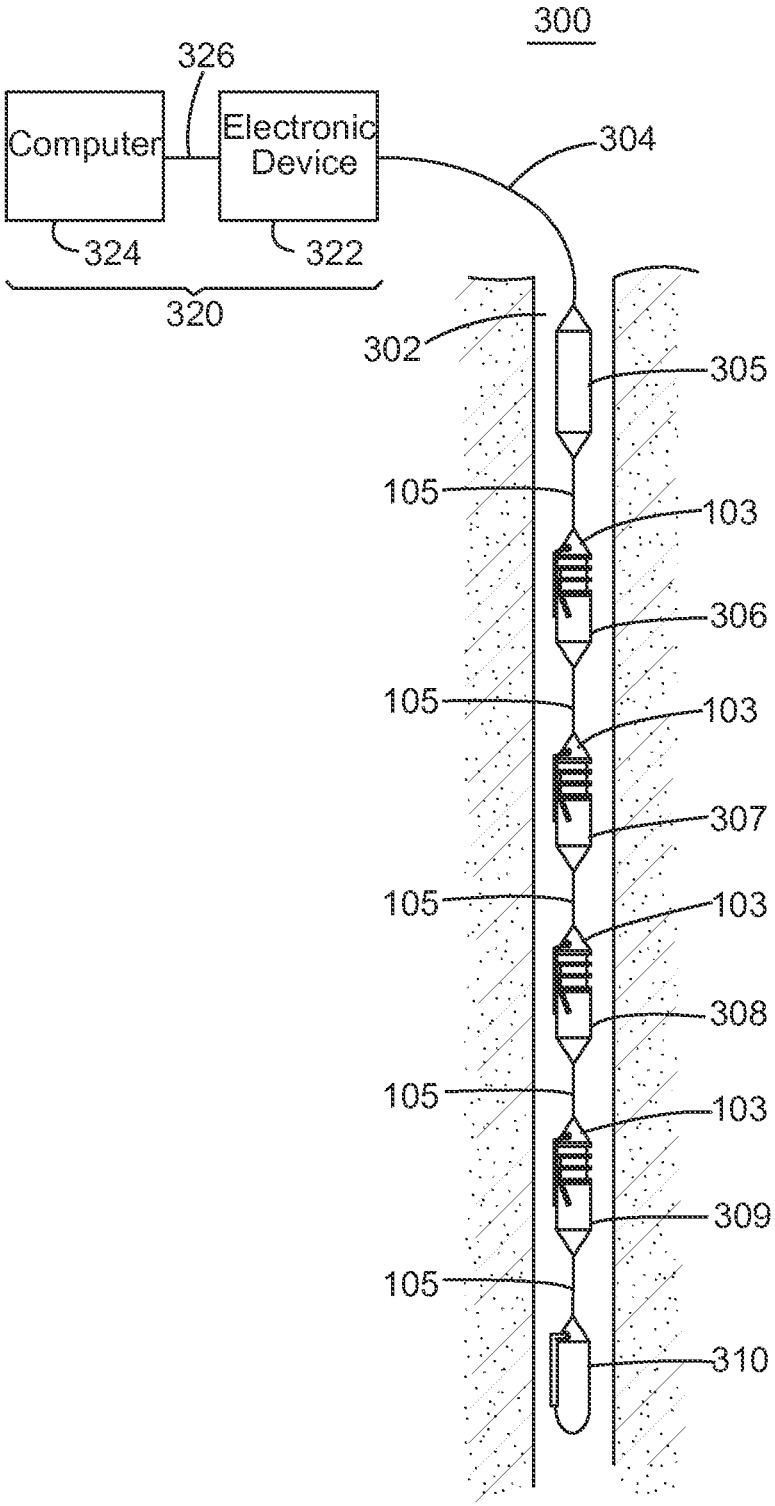
FIG. 3 illustrates a chain of downhole tools lowered inside a well.
Figure 4:
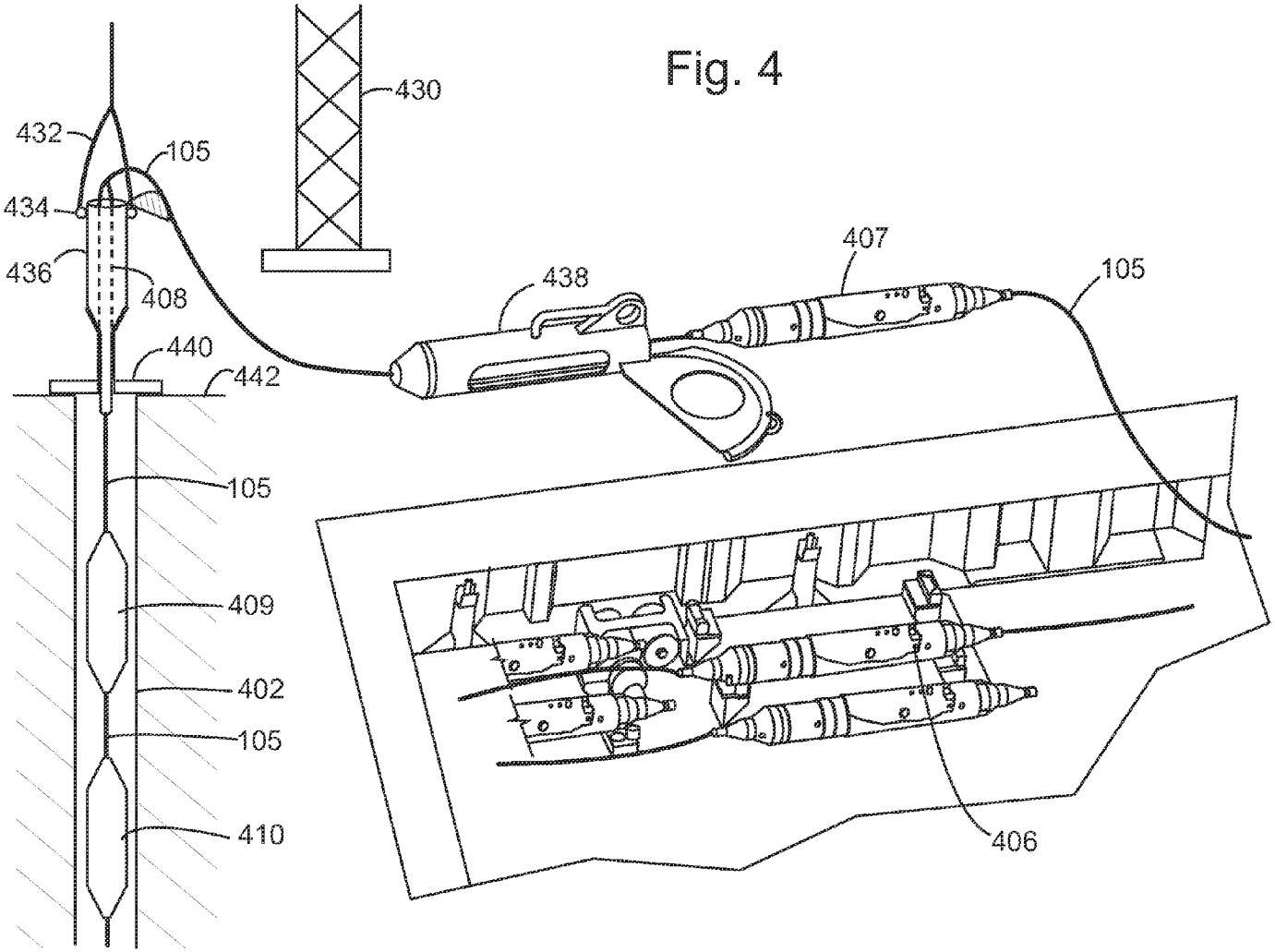
FIG. 4 illustrates a deployment device that deploys plural downhole tools inside a well.
Figure 8:
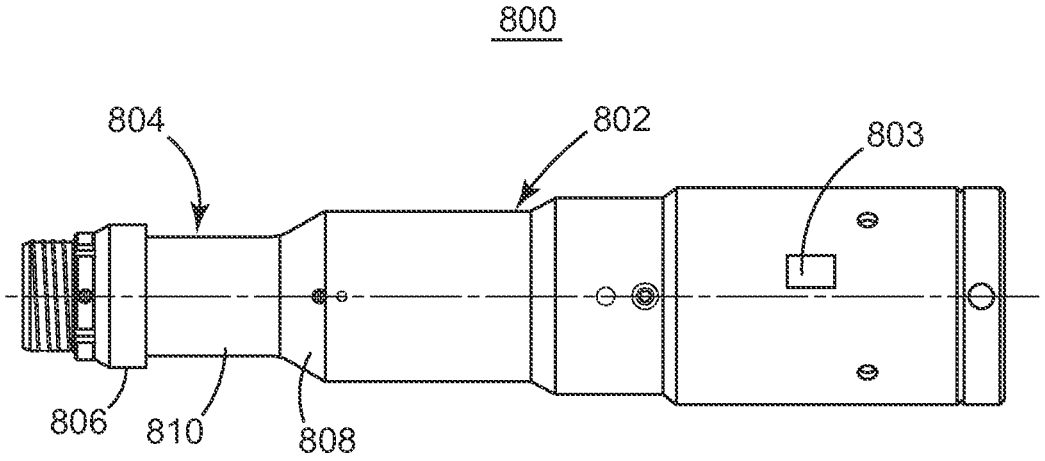
FIG. 8 is a cross-section of a downhole tool.

A tool 800 is illustrated in FIG. 8 and has a body 802 that houses one or more sensors 803. As discussed with regard to FIGS. 1 and 2, sensor 803 may be a seismic sensor (geophone, hydrophone, accelerometer, optical sensor), a temperature sensor, a pressure sensor, a pH sensor, etc. Tool 800 may have or not an anchoring arm (see 106 in FIG. 1) for contacting body 800 with a corresponding part of the well. Tool 800 has also a neck 804, called in the art the "fishing neck," which is used for recovering the tool when stuck in the well, or when the logging cable snaps. Fishing neck 804 has two shoulders 806 and 808, that define a cylindrical portion 810. In one embodiment, cylindrical portion 810 is smooth. In still another application, portion 810 has another shape, for example, rectangular, square, etc. Note that fishing neck 804 is a standard feature for the existing tools. However, fishing neck 804 may have different profiles, depending on the manufacturer. For example, fishing neck 804 may have a single shoulder 806 or similar feature.

Figure 9:
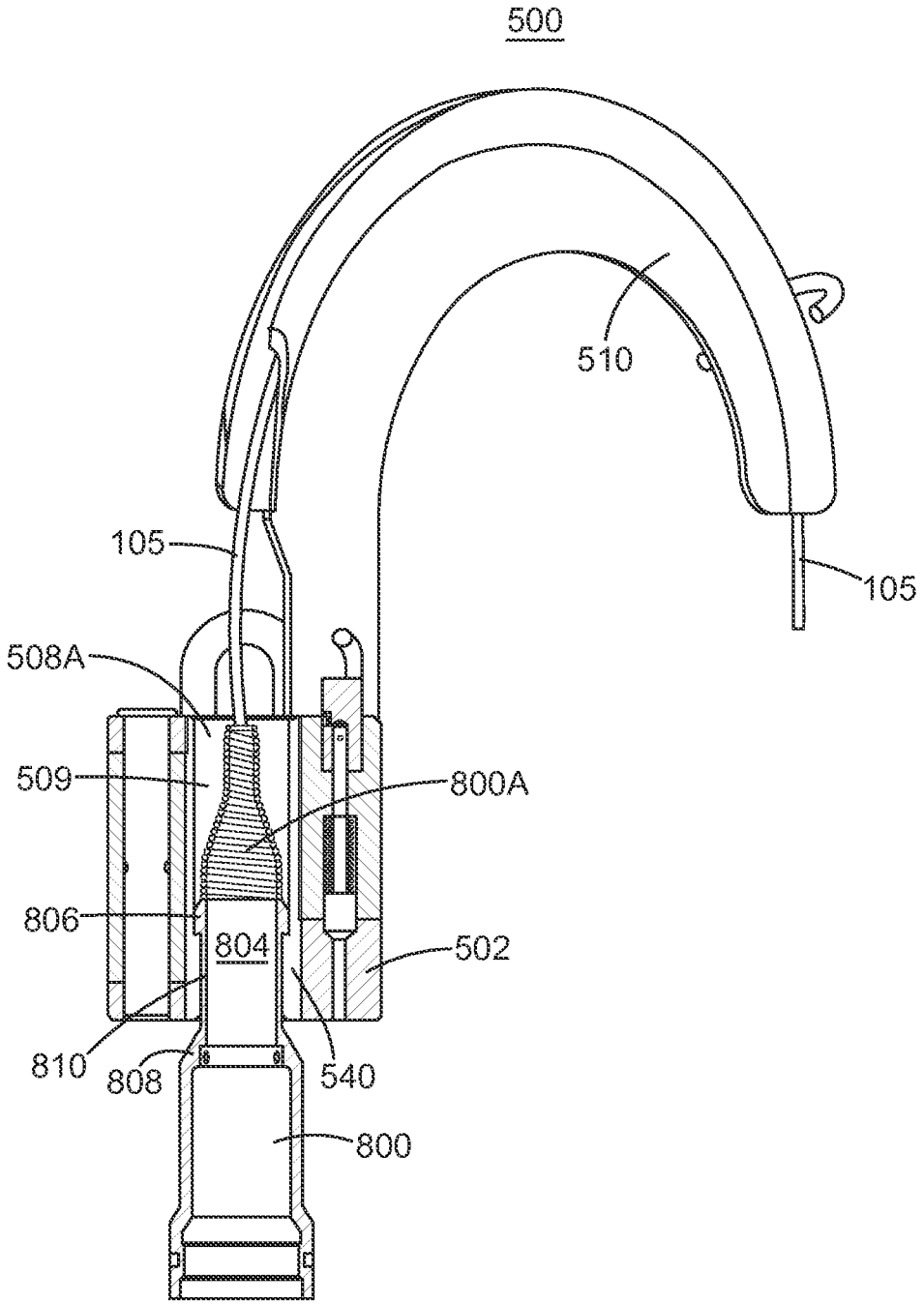
FIG. 9 shows in cross-section how the deployment device latches on a downhole tool.

The deployment device illustrated in FIGS. 5-7 takes advantage of the fishing neck 804, more specifically, of the shoulder 806, and has an interior of the latching compartment 509 configured to match part or the entire surface of cylindrical portion 810 and shoulder 806. In other words, as illustrated in FIG. 9, at least one of body 502 or door 504 has a shoulder 540 that fits around cylindrical portion 810 of tool 800, below shoulder 806, so that deployment device 500 engages tool 800 in a way that prevents tool 800 from falling out of deployment device's grip while deployment device is raised and lowered by the crane. This is so because deployment device 500's shoulder 540 engages tool 800's shoulder 806. FIG. 9 shows the interior of latching compartment 509 totally enclosing fishing neck 804. In one embodiment, latching compartment may enclose only partially fishing neck 804. In still another embodiment, the latching compartment only encloses a top portion 800A of tool 800. In another embodiment, both body 502 and door 504 have shoulder 540 to fully enclose tool 800's shoulder 806. Note that logging cable 105 is free to exit latching compartment 509 from a top portion 508A and follow bend restrictor 510 as illustrated in FIG. 9.

Figure 10:
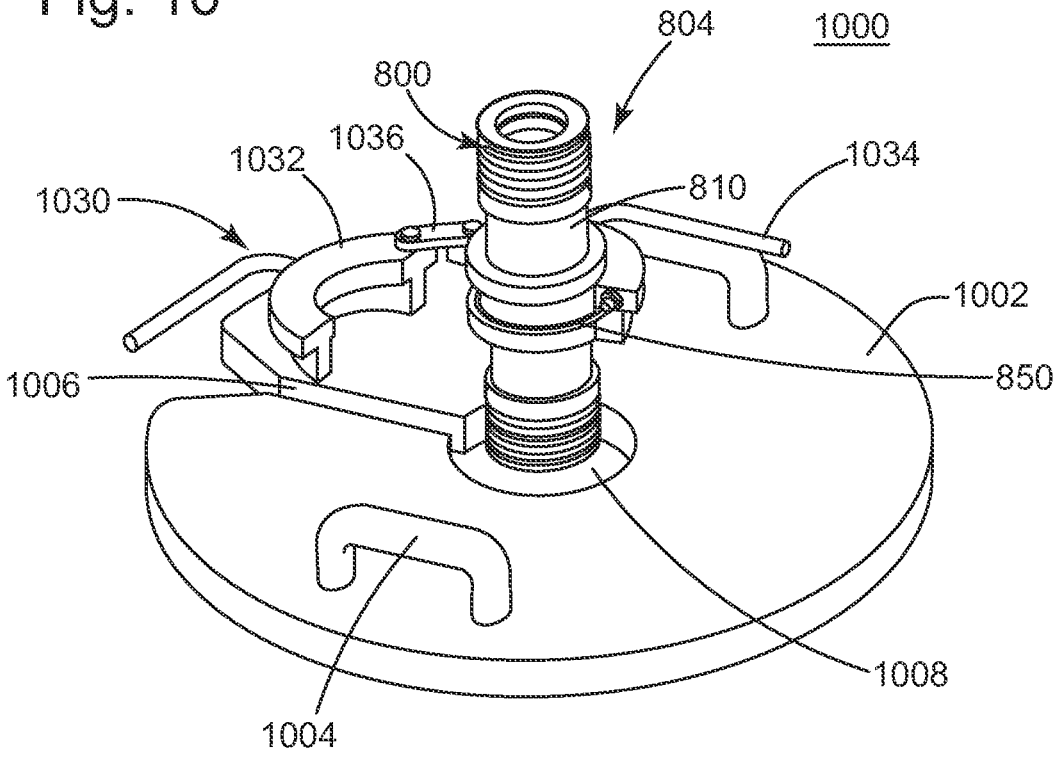
FIG. 10 illustrates a rig-up plate that supports a downhole tool.
Figure 11:
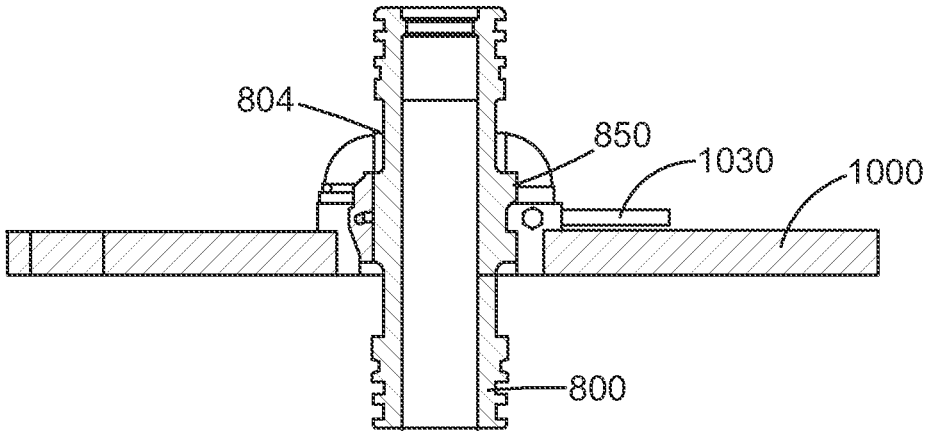
FIG. 11 illustrates a rig-up plate supporting a clamp attached to a downhole tool.

The deployment device 500 may be used in cooperation with a rig-up plate 1000, which is shown in FIG. 10. Rig-up plate 1000 has a body 1002 made of metal or other material that is capable to support the tools deployed inside the well. Body 1002 may have one or more handles 1004 attached to it and a slit 1006 through which logging cable 105 may slip into opening 1008. Opening 1008 is configured to receive tool 800's fishing neck 804. FIG. 10 shows region 810 above rig-up plate 1000 and free of the deployment device. The figure also shows a collar 850 that is manufactured or attached to tool 800, below fishing neck 804. The same is shown in FIG. 11 in cross section. Both FIGS. 10 and 11 also show a removable clamp 1030 that fits under collar 850 and conforms to the exterior diameter of tool 800. Clamp 1030 may have two parts 1032 and 1034 connected with a hinge 1036 to each other so that the operator can easily attach or detach clamp 1030 under collar 850. In one embodiment, collar 850 is replaced with two shoulders that form a groove and clamp 1030 fits into the groove.

Clamp 1030 is attached to tool 800 just prior to being lowered into the well as discussed next. Collar 850 may be fixedly attached to the tool, for example, it can be manufactured as an integral part of body 802 of the tool, or it may be removably attached with screws to the exterior of body 802. A position of the collar 850 relative to the top portion of the 800 may be calculated to fit various purposes. For example, when the safety of the operator is considered, the position of the collar relative to the top of the tool is so calculated to match a distance between the ground and arms of the operator. In this way, the operator does not need to bend or use a ladder when connecting the deployment tool to the fishing neck.

Figure 12:
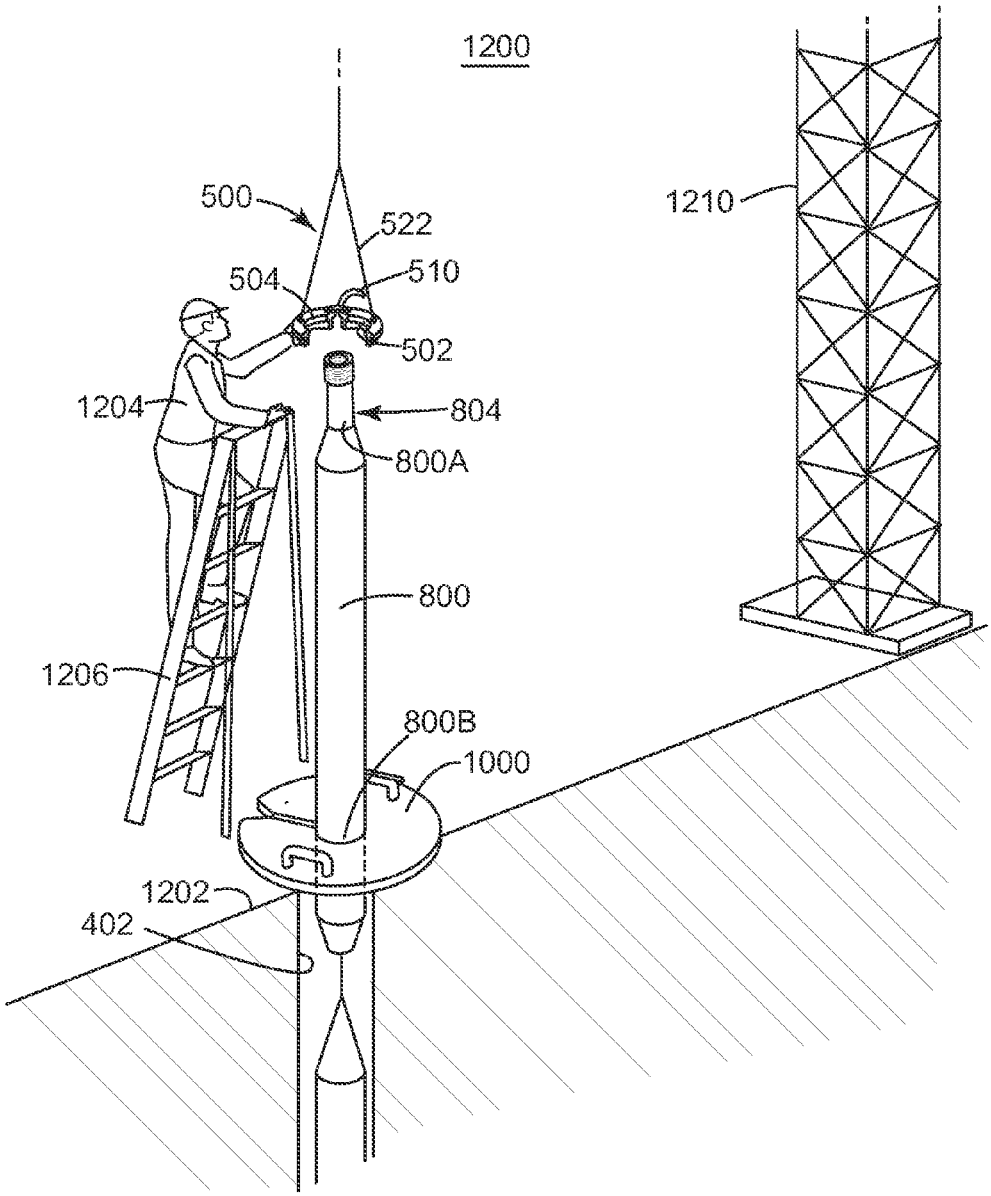
FIG. 12 illustrates a deployment process of plural downhole tools using a novel deployment device.

As illustrated in the deployment system 1200 of FIG. 12, if the tool 800 is high (e.g., 2 m long), when positioned on the rig-up plate 1000 with its bottom part 800B, its top part 800A having the fishing neck 804 is so high from the ground 1202 that an operator 1204 needs a ladder 1206 for attaching deployment device 500 to fishing neck 804. As crane 1210 (only partially illustrated) needs to be controlled to lower deployment device 500 to be latched onto fishing neck 804, the operator exposes herself to various dangers, e.g., falling from the ladder, being hit by the deployment device 500, etc.

Figure 13:
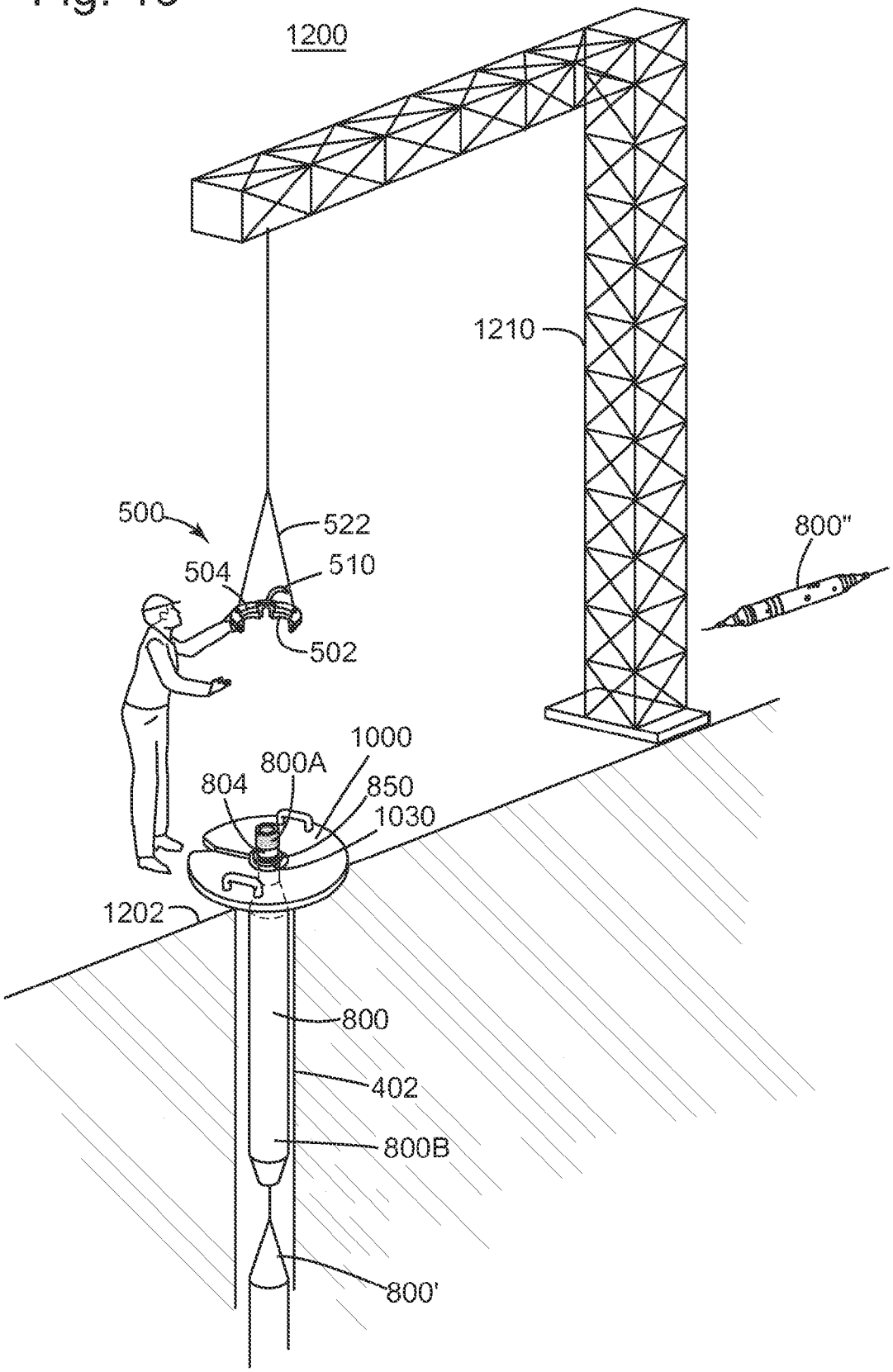
FIG. 13 illustrates a deployment process of plural downhole tools using a novel deployment device and a clamp.

Thus, according to an embodiment illustrated in FIG. 13, clamp 1030 is attached to a desired location (any location along the tool) along tool 800, so that a distance from clamp 1030 to top portion 800A of tool 800 does not exceed a distance from ground 1202 to operator's arms. In this way, the need to use a ladder is removed, and the safety during the deployment process is increased.

Therefore, a process of deploying the tools inside the well 402 is as now described. With reference to FIG. 13, a current tool 800 is raised with crane 1210, after deployment device 500 is attached to fishing neck 804. If other tools 800' are attached at the bottom portion 800B of tool 800, these tools already lay in the well 402 and crane 1210 raises the entire chain. Once current tool 800 is vertical, it is lowered until collar 850 is close to rig-up plate 1000. Clamp 1030 is attached beneath collar 850 and then current tool 800 is lowered until clamp 1030 sits on rig-up plate 1000. Note that if the arrangement shown in FIG. 13 is used, the diameter of opening 1008 in rig-up plate 1000 may be made to be larger than an exterior diameter of tool 800 so that the entire tool 800 can slide through the plate. If a clamp 1030 is not used, as illustrated in FIG. 12, the bottom portion 800B of tool 800 sits on rig-up plate 1000, as opening 1008 has a smaller diameter than an external diameter of current tool 800.

At this stage, the deployment device 500 is lowered and the entire weight of the chain of tools is distributed on clamp 1030. Deployment device 500 is removed from current tool and attached to a next tool 800" to be deployed. Once the deployment device 500 is latched to the next tool 800" to be deployed, crane 1210 raises the deployment device until next tool 800" is vertical and current tool 800 is moving upward, away from rig-up plate 1000. At this time, the operator removes clamp 1030 and/or rig-up plate 1000, and the current tool 800 is lowered inside the well while the next tool 800" is clamped and/or positioned on the rig-up plate. The process continues until all the tools are deployed inside the well.

Figure 14:
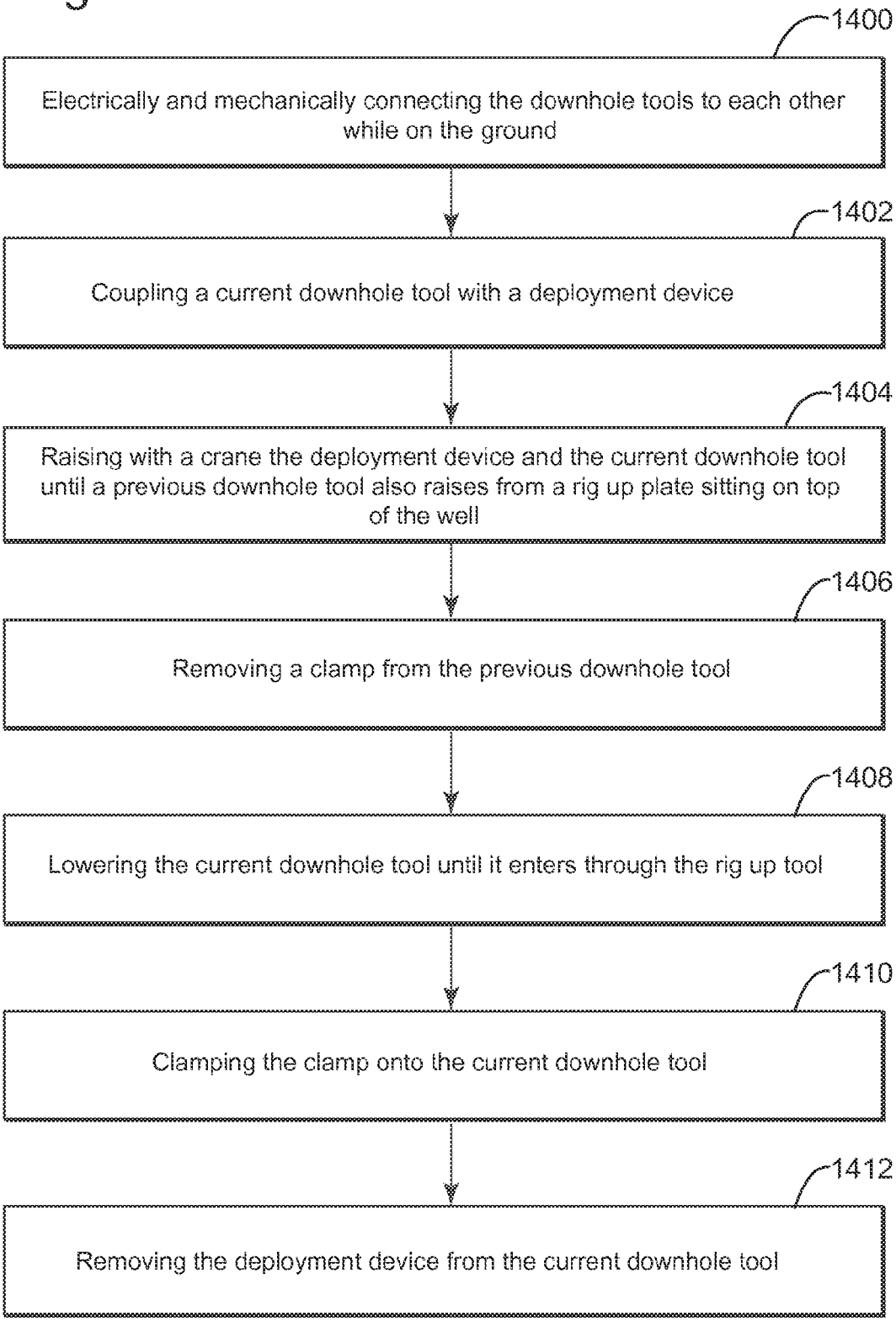
FIG. 14 is a flowchart of a method for deploying downhole tools inside a well with a single deployment device.

This process can be summarized as follows, with regard to FIG. 14. The method for deploying a chain of downhole tools inside a well includes a step 1400 of electrically and mechanically connecting the downhole tools to each other while on the ground; a step 1402 of coupling a current downhole tool with a deployment device, wherein the deployment device is configured to latch on a fishing neck of the current downhole tool; a step 1404 of raising with a crane the deployment device and the current downhole tool until a previous downhole tool also raises from a rig-up plate sitting on top of the well; a step 1406 of removing a clamp from the previous downhole tool; a step 1408 of lowering the current downhole tool until it enters through the rig-up tool; a step 1410 of clamping the clamp onto the current downhole tool; and a step 1412 of removing the deployment device from the current downhole tool.

The method may also include a step of coupling the deployment device to a next downhole tool while the current downhole tool sits on the rig-up plate due to the clamp, a step of raising with the deployment device the next downhole tool until the current deployment device separates from the rig-up plate; a step of removing the clamp from the current downhole tool; and a step of lowering the current downhole tool through the rig-up plate into the well.

Note that the step of clamping includes attaching the clamp to the current downhole tool so that a distance from the clamp to a top portion of the current downhole tool matches a distance from the ground to the arms of an operator operating the deployment device.

In this way, the deployment tool 500 according to one or more embodiments disclosed above is smaller than the traditional bottle, which makes the manipulation of the tool much easier and safer. By introducing clamp 1030, a height of the fishing neck relative to the ground can be adjusted so that the operator does not need a ladder for coupling the deployment device to the tool. Further, this method allows connecting all the tools on the ground to each other, testing the entire chain and then deploying the chain, tool by tool, without the need to disconnect the tools from each other. Thus, the deployment time is reduced, which positively affects the cost of the operation. Because the deployment device couples to the fishing neck of the existing tools, it can be used with any existing tool. Further, with this deployment device, there is no need to use a second deployment device.

The disclosed exemplary embodiments provide an apparatus and method for deploying one or more tool inside a well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A deployment device for a downhole tool comprising:

a body;

a door rotatably attached to the body and configured to have an open position for allowing at least a portion of a fishing neck of the downhole tool to contact the body and a close position that secures the at least a portion of the fishing neck inside the deployment device;

a bend restrictor attached to the body and configured to receive a logging cable of the downhole tool; and a locking mechanism for securing the door in the close position, wherein the fishing neck is located at a top portion of the downhole tool, and the top portion of the downhole tool is located inside the deployment device for the close position.

2. The deployment device of claim 1, wherein the body and the door form a latching compartment when the door is in the close position and the latching compartment encloses only a portion of the fishing neck.

3. The deployment device of claim 1, wherein the body and the door form a latching compartment when the door is in the close position and the latching compartment encloses only the fishing neck.

4. The deployment device of claim 1, wherein the body and the door form a latching compartment when the door is in the close position and the latching compartment encloses only the top portion of the downhole tool.

5. The deployment device of claim 1, wherein the body and the door form a latching compartment when the door is in the close position and the latching compartment has a compartment shoulder.

6. The deployment device of claim 5, wherein the at least a portion is a tool shoulder on the fishing neck and the compartment shoulder is configured to contact the tool shoulder.

7. The deployment device of claim 6, wherein when the deployment device is raised by a crane, the compartment shoulder engages the tool shoulder so that the tool is also raised.

8. The deployment device of claim 1, wherein the bend restrictor comprises:

a groove that accommodates the logging cable; and a clamp that secures the logging cable to the bend restrictor.

9. A deployment system for deploying plural downhole tools in a well, the deployment system comprising:

the plural downhole tools for measuring at least one parameter within the well;

a deployment device for deploying the plural downhole tools;

a rig-up plate for covering a head of the well and supporting the plural downhole tools already deployed in the well; and a crane configured to connect to the deployment device, wherein the deployment device is configured to latch onto at least a portion of a fishing neck of a downhole tool from the plural downhole tools, the fishing neck is located at a top portion of the downhole tool, and the top portion of the downhole tool is located inside the deployment device.

10. The deployment system of claim 9, further comprising:

a clamp configured to be attached to the downhole tool for supporting the downhole tool when placed on the rig-up plate and the deployment device is removed.

11. The deployment system of claim 10, wherein the downhole tool has a collar, in addition to a shoulder, for engaging the clamp.

12. The deployment system of claim 10, wherein the clamp is hand-operated and is configured to be attached to the downhole tool at a distance from the top portion of the downhole tool allowing hand operation of the clamp.

13. The deployment system of claim 9, wherein an opening within the rig-up plate has a diameter larger than an outside diameter of the downhole tool so that the downhole tool can pass through the rig-up plate when deployed in the well.

14. The deployment system of claim 9, wherein the downhole tool has a seismic sensor.

15. The deployment system of claim 14, wherein the downhole tool has an anchoring arm configured to contact the well when the downhole tool is in place inside the well.

16. A method for deploying a chain of downhole tools inside a well, the method comprising:

electrically and mechanically connecting the downhole tools to each other while on the ground;

coupling a current downhole tool of the downhole tools with a deployment device, wherein the deployment device is configured to latch on at least a portion of a fishing neck of the current downhole tool, the fishing neck is located at a top portion of the current downhole tool, and the top portion of the current downhole tool is located inside the deployment device;

raising with a crane the deployment device and the current downhole tool until a previous downhole tool of the downhole tools also raises from a rig-up plate sitting on top of the well;

removing a clamp from the previous downhole tool;

lowering the current downhole tool until the current downhole tool enters through the rig-up plate;

clamping the clamp onto the current downhole tool; and removing the deployment device from the current downhole tool.

17. The method of claim 16, further comprising:

coupling the deployment device to a next downhole tool of the downhole tools while the current downhole tool sits on the rig-up plate due to the clamp.

18. The method of claim 17, further comprising:

raising with the deployment device the next downhole tool until the current downhole tool separates from the rig-up plate;

removing the clamp from the current downhole tool; and lowering the current downhole tool through the rig-up plate into the well.

19. The method of claim 16, wherein the clamp is hand-operated and is configured to be attached to the downhole tool at a distance from the top portion of the downhole tool allowing hand operation of the clamp.

20. The method of claim 16, wherein the deploying device has a body and a door that form a latching compartment and the latching compartment has a shoulder that engages a corresponding shoulder of the current downhole tool.

* * * * *